United States Patent [19]

Flumignan

[11] Patent Number: 4,733,028

[45] Date of Patent: Mar. 22, 1988

[54] SWITCH

[75] Inventor: Dennis P. Flumignan, Sterling Heights, Mich.

[73] Assignee: Microdot Inc., Darien, Conn.

[21] Appl. No.: 6,918

[22] Filed: Jan. 27, 1987

[51] Int. Cl.[4] ..... H01H 1/42; H01H 13/02; H01H 15/02

[52] U.S. Cl. ..... 200/16 B; 200/16 F; 200/61.76; 200/159 A; 200/254; 200/282

[58] Field of Search ..... 200/16 A, 16 B, 16 C, 200/16 E, 61.62, 61.64, 61.76–61.78, 159 A, 159 R, 254, 240–242, 61.89

[56] References Cited

U.S. PATENT DOCUMENTS

| | | | |
|---|---|---|---|
| 2,606,263 | 8/1952 | Woodward | 200/61.76 X |
| 3,735,058 | 5/1973 | Berry | 200/61.76 X |
| 3,818,169 | 6/1974 | Kobernus | 200/159 A |
| 3,989,912 | 11/1976 | Francke | 200/159 A |
| 4,249,086 | 2/1981 | Mochizuki | 200/159 A X |
| 4,371,759 | 2/1983 | Clark, Jr. | 200/159 A X |
| 4,497,983 | 2/1985 | Galloway et al. | 200/16 B |
| 4,675,486 | 6/1987 | Niinuma | 200/282 X |

*Primary Examiner*—J. R. Scott

*Attorney, Agent, or Firm*—Lyman R. Lyon

[57] ABSTRACT

A low voltage switch having relatively long plunger travel that maximizes internal self-wiping of the contacts thereby to prolong switch life. The support for the internal contacts functions as a guide for the plunger as well as providing the necessary electrical spacing.

1 Claim, 4 Drawing Figures

SWITCH

BACKGROUND OF THE INVENTION

This invention relates generally to electrical switches, and more particularly to small heavy duty electrical plunger switches used in low voltage applications. A need has arisen for an improved easily manufactured electrical switch that exhibits (a) relatively long plunger travel, (b) corrosion resistance (c) immunity to the deleterious effects of water, and (d) a wiping action for self-cleaning of the switch contacts.

SUMMARY OF THE INVENTION

The switch of the instant invention is ideal for low voltage applications in that the relatively long plunger travel maximizes internal self-wiping of the contacts thereby to prolong switch life. The support for the internal contacts functions as a guide for the plunger as well as providing the necessary electrical spacing.

DETAILED DESCRIPTION OF THE PREFERRED EMBODIMENT OF THE INVENTION

Figure 1:
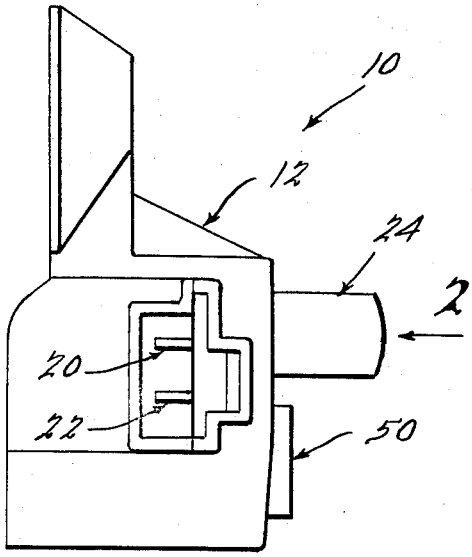
FIG. 1 is a side elevational view of an electrical switch of the present invention.
Figure 2:
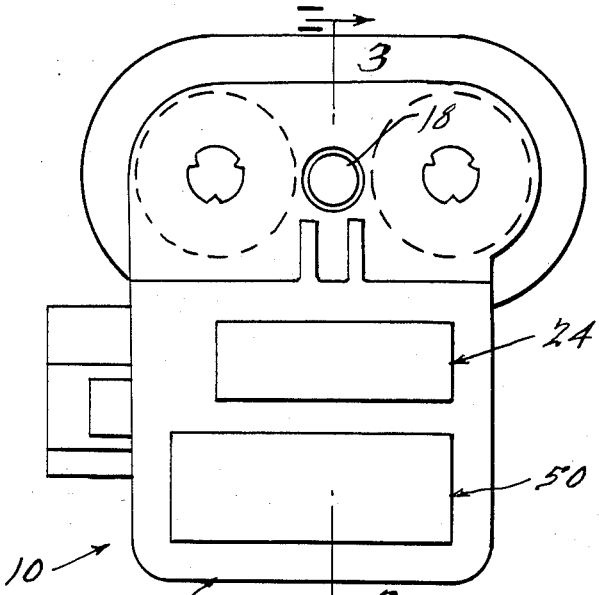
FIG. 2 is an elevational view taken in the direction of the arrow 2 of FIG. 2.
Figure 4:
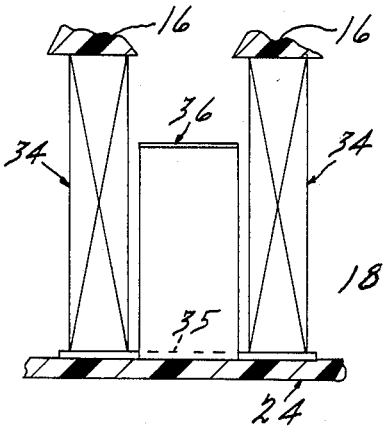
FIG. 4 is a view taken in the direction of the arrow 4 of FIG. 3.

In accordance with a preferred and constructed embodiment of the present invention, a normally open spring biased plunger switch 10 comprises a housing 12 having a front housing portion 14 and a rear housing portion 16 secured to one another by a plurality of rivets 18. A pair of terminals 20 and 22 extend from the housing 12 for connection to external conductors, not shown.

Figure 3:
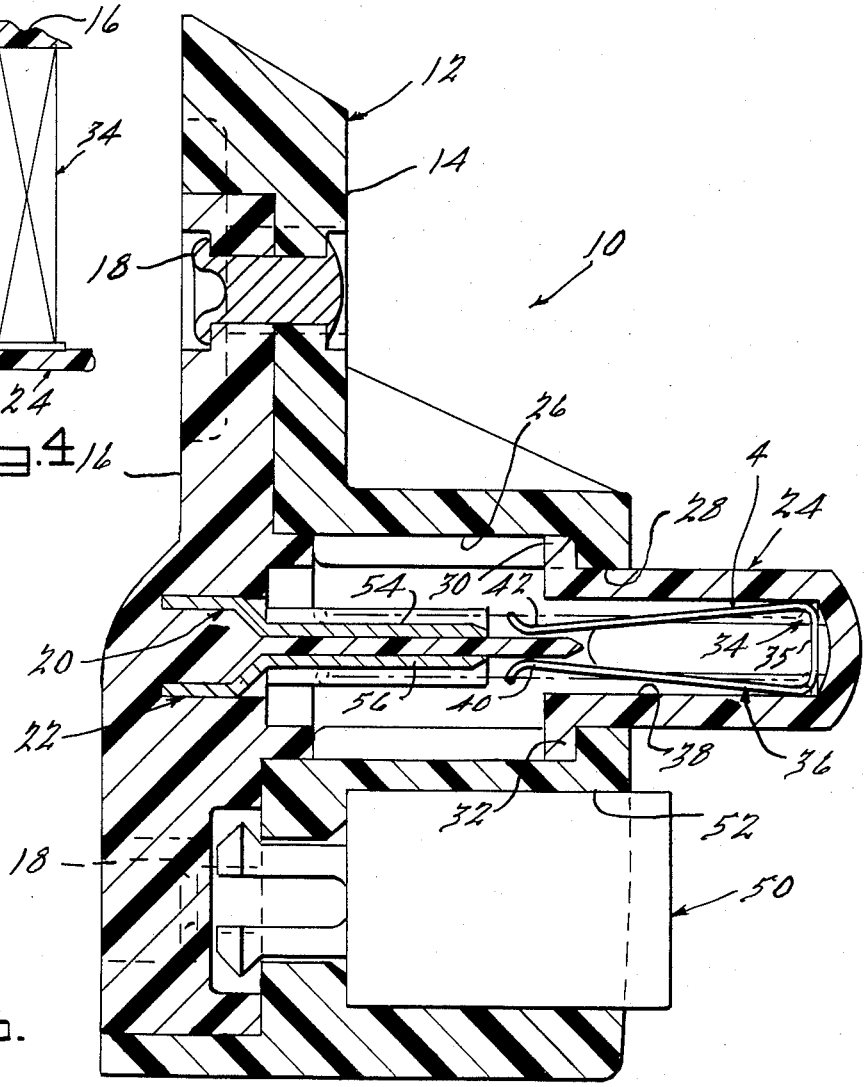
FIG. 3 is a side elevational view taken along line 3—3 of FIG. 2 showing the internal configuration of said switch with the plunger in its outermost position.

As best seen in FIG. 3, a plunger 24 is disposed within a chamber 26 and is movable between two extreme longitudinal positions. The plunger 24 extends outwardly of the housing 12 through a passage 28 in the front housing member 14. Laterally extending shoulders 30 and 32 on the plunger 24 interact with the walls of the chamber 26 to limit the plunger's inward and outward travel. A pair of helical compression springs 34, one of which is shown in FIG. 3, engage opposite sides of a bight portion 35 of a U-shaped contact 36. The springs 34 and contact 36 are accepted in a complementary cavity 38 in the plunger 24, and maintain an outward bias thereon at all times.

The U-shaped contact 36 comprises a pair of conductive legs 40 and 42 connected by a bight portion 44. The legs 40 and 42 are separated at all times by an insulating partition 44 on the rear housing portion 16 which also supports and separates the terminals 20 and 22 from one another.

A relatively heavy bumper 50 is supported in a complementary cavity. 52 in the housing 12 for the acceptance of shock loads on the switch 10 from, for example, a brake pedal, not shown.

In operation, pressure on the plunger 24 effects movement thereof into the housing 12 against the bias of the springs 34. The plunger carries the contact 36 towards the terminals 20 and 22, the legs 40 and 42 of the contact 36 engaging and riding over inner end portions 54 and 56 of the terminals 20 and 22, respectively, in extended wiping contact.

While the preferred embodiment of the invention has been disclosed, it should be appreciated that the invention is susceptible of modification without departing from the scope of the following claims.

I claim:

1. An electrical switch comprising:

an insulating housing defining a chamber having an opening therein, a pair of electrically conductive terminals extending into said chamber, an insulating member extending into said chamber between and beyond said terminals in juxtaposed supporting relation thereto, a plunger, extending outwardly of said chamber through the opening therein and movable relative thereto and to said terminals, spring means normally biasing said plunger outwardly of said housing, a U-shaped conductive contact member supported by said plunger for movement therewith, said contact member having spaced leg portions engageable with said terminals, respectively, to complete an electrical circuit therebetween, engagement of said contact member with said terminals moving the leg portions of said contact member away from one another thereby to develop inherent resilient contact pressure on said terminals, respectively, the insulating member on said housing extending between the legs of said contact member at all positions of said plunger and supporting said terminals in compression against contact pressure exerted by the leg portions of said contact member.

* * * * *